US010006729B2

(12) United States Patent
Mantas

(10) Patent No.: US 10,006,729 B2
(45) Date of Patent: Jun. 26, 2018

(54) REDUCED STROKE LENGTH TELESCOPIC RECOIL MECHANISM

(71) Applicant: Dimitrios Mantas, Athens (GR)

(72) Inventor: Dimitrios Mantas, Athens (GR)

( * ) Notice: Subject to any disclaimer, the term of this patent is extended or adjusted under 35 U.S.C. 154(b) by 0 days. days.

(21) Appl. No.: 15/637,210

(22) Filed: Jun. 29, 2017

(65) Prior Publication Data

US 2018/0010870 A1 Jan. 11, 2018

Related U.S. Application Data

(60) Provisional application No. 62/359,399, filed on Jul. 7, 2016.

(51) Int. Cl.
*F41A 3/86* (2006.01)

(52) U.S. Cl.
CPC ..... *F41A 3/86* (2013.01)

(58) Field of Classification Search
CPC ..... F41A 3/84; F41A 3/86
See application file for complete search history.

(56) References Cited

U.S. PATENT DOCUMENTS 1,877,839 A * 9/1932 Frommer ..... F41A 3/86 89/177
2,286,133 A * 6/1942 Williams ..... F41A 3/32 89/179
4,031,808 A * 6/1977 Raville ..... F41A 3/86 89/163
4,201,113 A * 5/1980 Seecamp ..... F41A 3/86 89/163
4,485,723 A * 12/1984 Sarony ..... F41A 3/86 89/163
5,710,389 A * 1/1998 Canaday ..... F41A 3/54 89/180
7,493,845 B2 2/2009 Mantas
8,297,176 B2 * 10/2012 Buschow ..... F41A 3/86 89/196
8,939,059 B2 * 1/2015 Coffman, II ..... F41A 3/82 89/177
9,080,823 B1 7/2015 Mantas
9,651,323 B1 * 5/2017 Mantas ..... F41A 3/86

FOREIGN PATENT DOCUMENTS

WO WO-9615416 A1 * 5/1996 ..... F41A 3/86

OTHER PUBLICATIONS

U.S. Appl. No. 14/930,901, filed Nov. 3, 2015.

* cited by examiner

*Primary Examiner* — Stephen Johnson
*Assistant Examiner* — Joshua T Semick
(74) *Attorney, Agent, or Firm* — Notaro, Michalos & Zaccaria P.C.

(57) ABSTRACT

A reduced stroke length telescopic recoil mechanism for a firearm having a barrel and a slide movable rearwardly with respect to the barrel during an initial part of a firing cycle, and forwardly during an ending part of the firing cycle, the recoil mechanism having a base, an axle fixed to the base, a central tube slidably mounted on the axle, an inner spring engaged between the base and the central tube for biasing the central tube forwardly away from the base, an outer tube slidably mounted with respect to the central tube, a central spring engaged between the central tube and the outer tube for biasing the central tube forwardly away from the base, and an outer spring engaged between the slide and the outer tube for biasing the slide forwardly of the base.

10 Claims, 6 Drawing Sheets

REDUCED STROKE LENGTH TELESCOPIC RECOIL MECHANISM

FIELD AND BACKGROUND OF THE INVENTION

The present invention relates generally to the field of firearms and in particular to a new and useful recoil mechanism for short action firearms such as short barrel handguns and other firearms that require a reduced stroke length to cycle rounds.

The inventor's previous U.S. Pat. No. 7,493,845 discloses a recoil mechanism for a gun having a frame, a barrel and a slide, the mechanism having a cylinder with a rear part with external flange and an internal diaphragm spaced forwardly of the flange and between a rear chamber and a front chamber in the cylinder. A nut is fixed to the frame and an axle has a rear end threaded to the nut and extending in the cylinder. The axle has a collar trapped in the front chamber by the diaphragm. A first spring around the cylinder, has a front end abutting the slide and a rear end abutting the flange. A second spring extending at least partly in the rear chamber has a rear end abutting the nut and a front end abutting the diaphragm. A third spring in the front chamber, is shorter in length than the front chamber and a recoil adjusting plug is used with or without the recoil mechanism.

The inventor's U.S. Pat. No. 9,080,823 discloses a buffer assembly for an AR type firearm, having a rod and a cap with a forward end against which a bolt carrier pushes during a firing cycle. The cap is movable along the rod. A shock absorbing plug is attached to a rearward end of the rod for engaging an end wall of a receiver extension during an intermediate part of the firing cycle, a buffer tube is moveable on the rod, a buffer spring is engaged between the plug and the buffer tube for biasing the buffer tube toward a forward position and a counterweight is mounted for movement on the rod. A shock absorbing washer is provided between the counterweight and the cap for smoothing an impact between the counterweight and the cap at an end of the firing cycle and a counterweight spring that is weaker than the buffer spring, is provided for biasing the counterweight toward the cap.

The inventor's pending U.S. patent application Ser. No. 14/930,901 filed Nov. 3, 2015 discloses a telescopic recoil system for a firearm having a receiver and a bolt carrier that includes a recoil system base, an axle fixed to the base, a central buffer tube slidably mounted on the axle, an axle buffer spring between the base and central buffer tube, biasing the central buffer tube away from the base, an outer tube slidably mounted on a forward portion of the central buffer tube, a spring buffer tube slidably mounted on a rearward portion of the central buffer tube, a rear buffer spring between the base and spring buffer tube, biasing the spring buffer tube away from the base, a central spring between the spring buffer tube and outer tube, biasing the outer tube away from the spring buffer tube and away from the base and an exchangeable spring between the outer tube and the bolt carrier, biasing the outer tube away from the bolt carrier. This mechanism is well suited to recoil systems for firearms having a long stroke but small diameter space to accommodate the mechanism.

Certain firearms, in particular but not exclusively short barrel autoloading pistols, have room for only a short loading cycle stroke. Examples include the Glock 26 and other autoloading firearms with 3 inch or shorter barrels, and handguns such as the STRIKE ONE and STRIKE TWO model pistols by Arsenal Firearms, which have block locking systems that use up a substantial portion of length in the frame under the barrel, that would otherwise house the recoil mechanism. See demonstrations of this type of pistol at https://www.youtube.com/watch?v=qufoD83K4PE and https://www.youtube.com/watch?v=wQjcMI0sYc.

A need remains for further improvements in the recoil and/or buffer mechanisms of firearms to accommodate short stroke loading cycles.

SUMMARY OF THE INVENTION

It is an object of the present invention to provide a reduced stroke length telescopic recoil mechanism for a firearm having a barrel and a slide movable rearwardly with respect to the barrel during an initial part of a firing cycle, and forwardly during an ending part of the firing cycle, the recoil mechanism having a base; an axle fixed to the base; a central tube slidably mounted on the axle; an inner spring engaged between the base and the central tube for biasing the central tube forwardly away from the base; an outer tube slidably mounted with respect to the central tube; a central spring engaged between the central tube and the outer tube for biasing the central tube forwardly away from the base; and an outer spring engaged between the slide and the outer tube for biasing the slide forwardly of the base.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
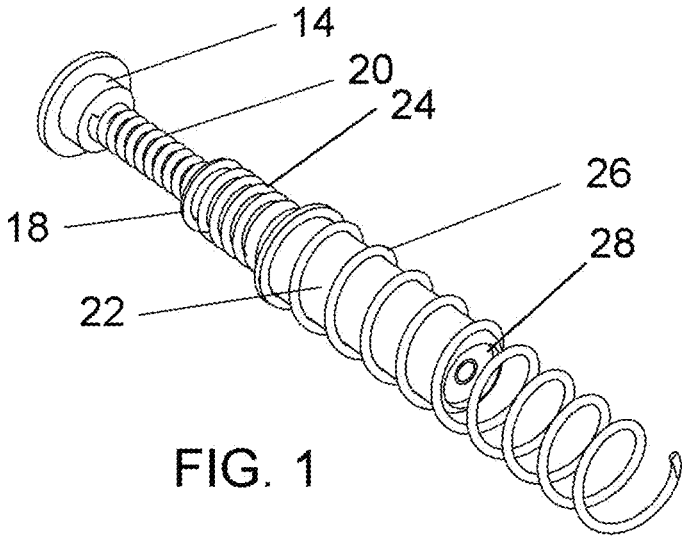
FIGS. 1 and 2 are perspective views taken from different angles of a reduced stroke length telescopic recoil mechanism for a firearm according to the invention.
Figure 2:
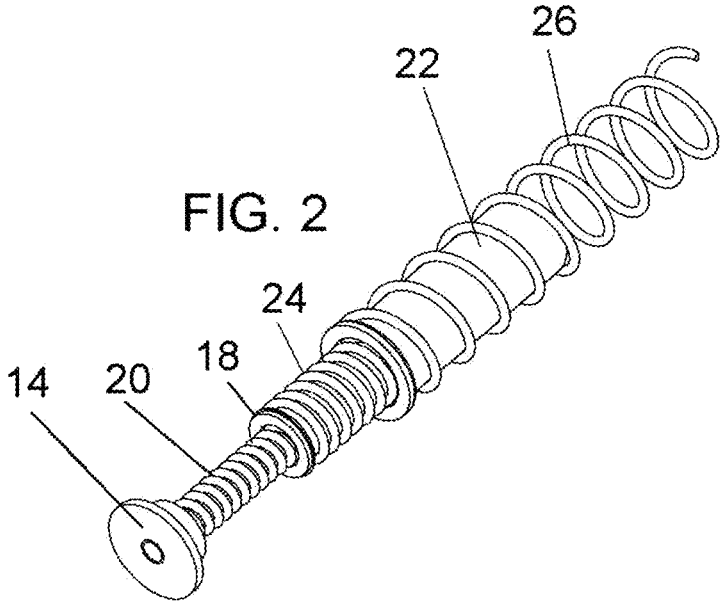
Figure 3:
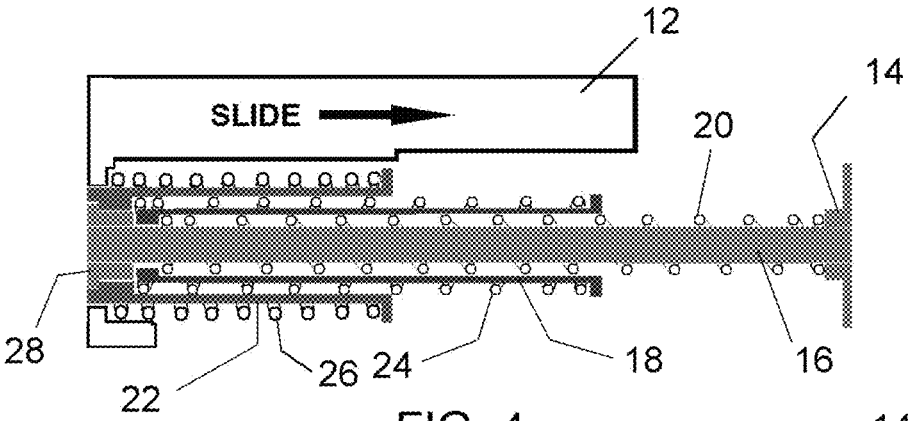
FIG. 3 is a sectional view of the recoil mechanism of the invention with part of a firearm slide visible and at a rest position before a shot has been fired.
Figure 7:
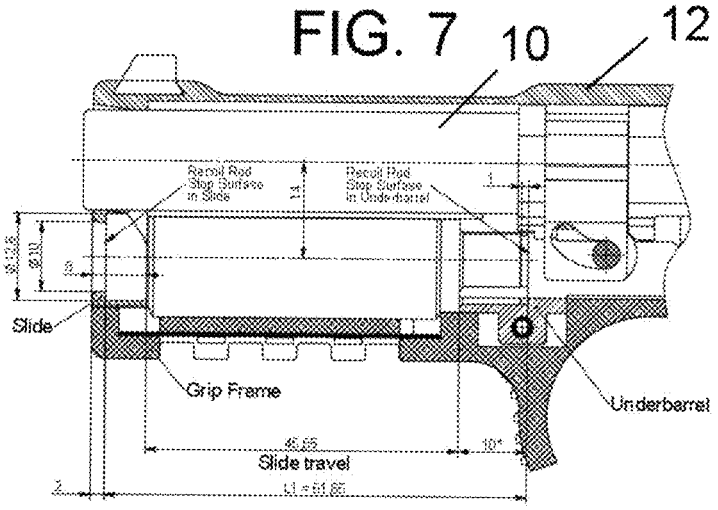
FIG. 7 is a partial sectional view of a short stroke, auto-loading pistol of the type that can but equipped with the recoil mechanism of the invention, in rest position.
Figure 8:
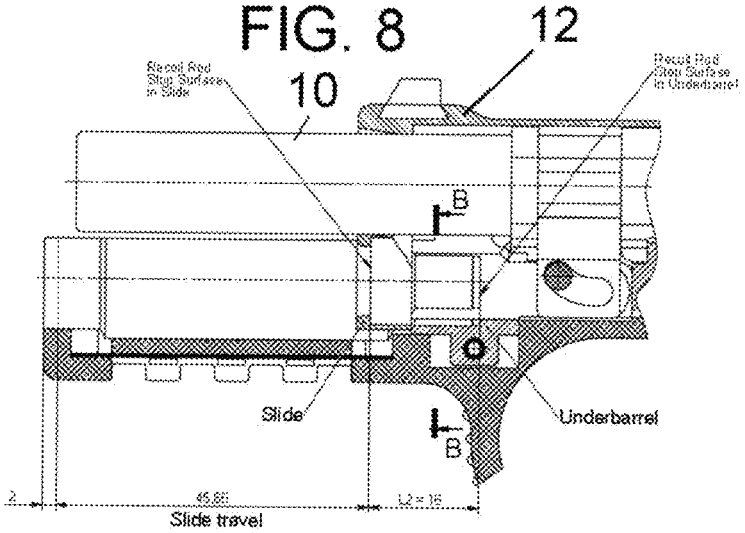
FIG. 8 is a partial sectional view of the short stroke, auto-loading pistol of FIG. 7, in a rearward most position for its slide during a firing cycle.
Figure 9:
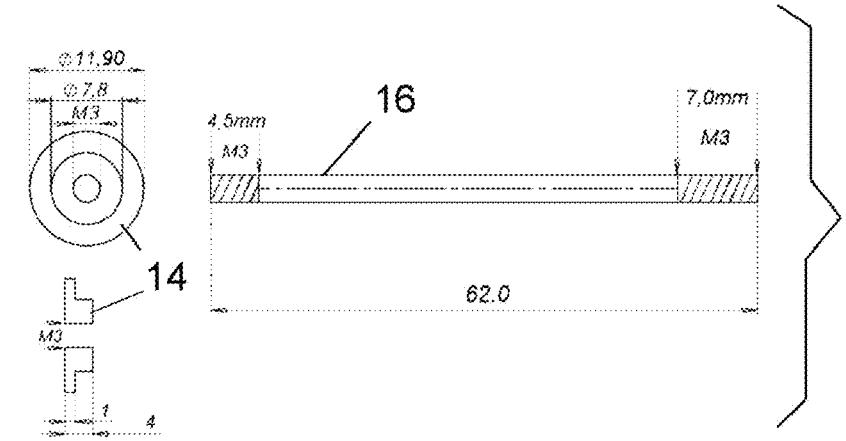
FIGS. 9 to 15, illustrate details of the components of the reduced stroke length, telescopic recoil mechanism of the invention.

Referring now to the drawings, in which like reference numerals are used to refer to the same or similar elements, FIGS. 1, 2 and 3 illustrate a reduced stroke length, telescopic recoil mechanism for a firearm having a barrel 10 (shown in FIGS. 7 and 8) and a slide 12 movable rearwardly with respect to the barrel during an initial part of a firing cycle, and forwardly during an ending part of the firing cycle.

Figure 11:
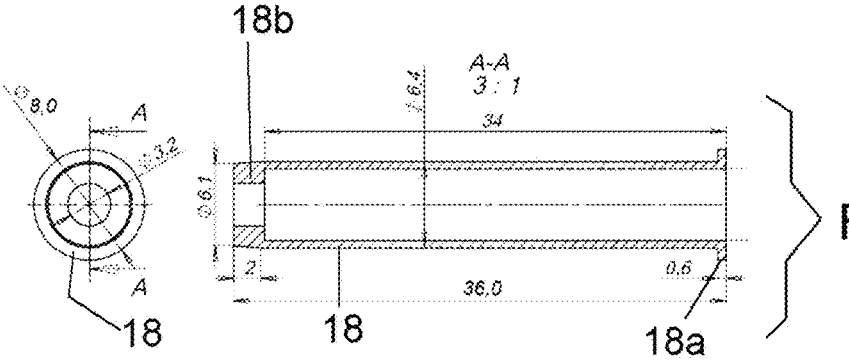
Figure 12:
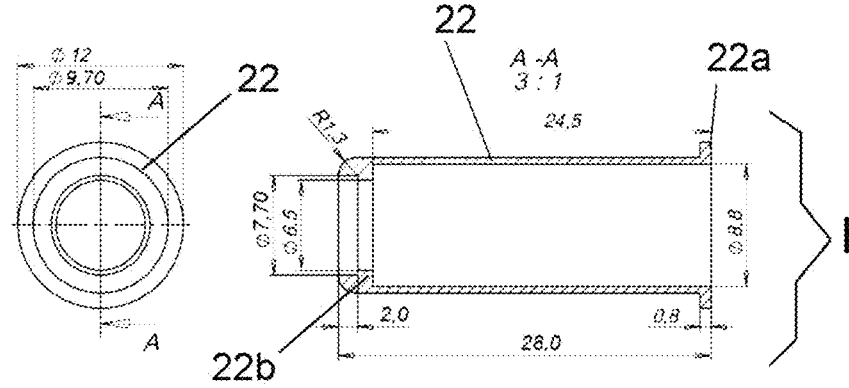
Figure 10:
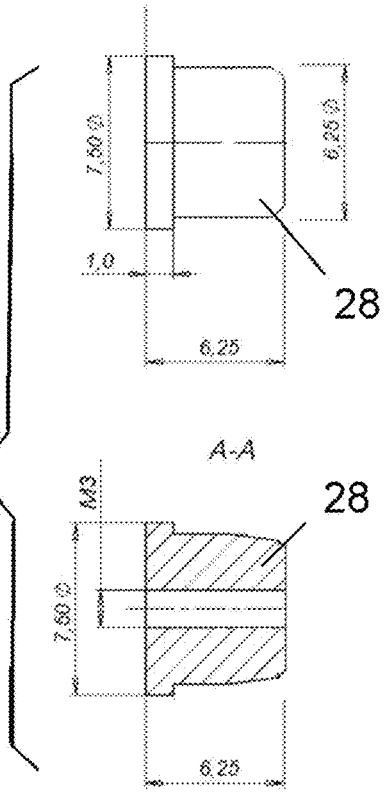
Figure 13:
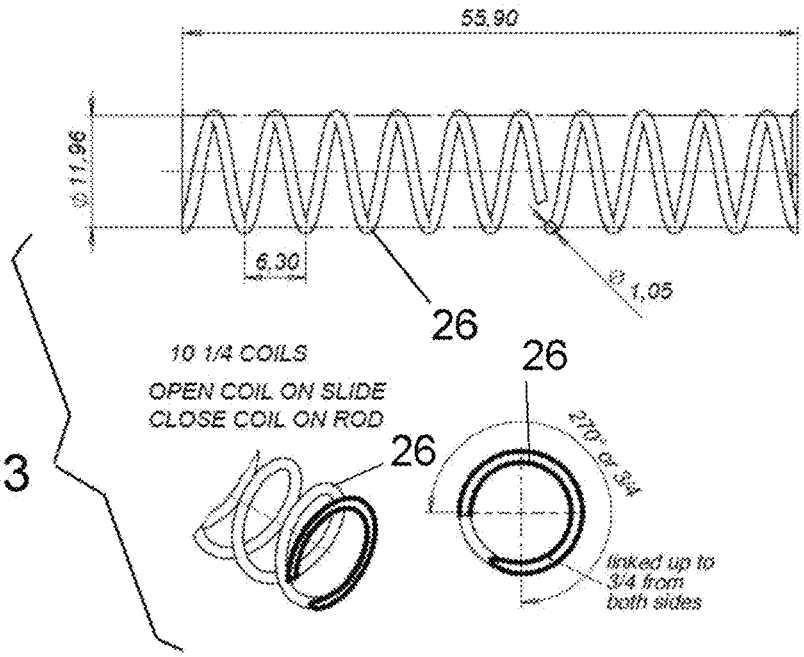
Figure 14:
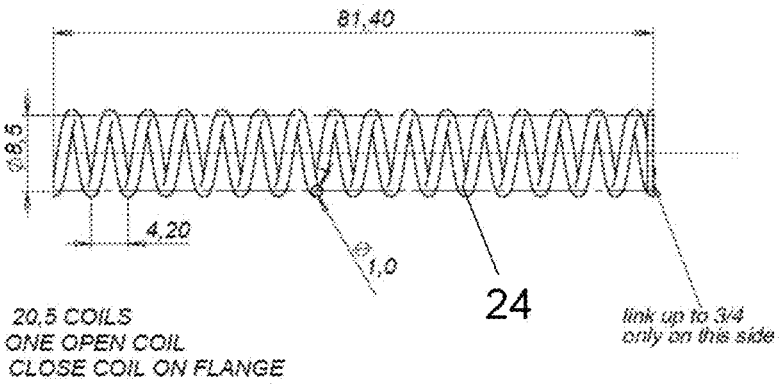
Figure 15:
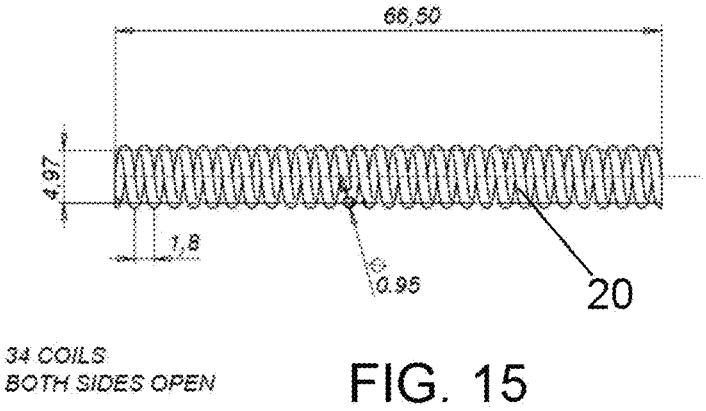

The recoil mechanism of the invention includes a base 14 in the form of a stepped flange to which an axle 16 is fixed, for example, by mating threads. A central tube 18 is slidably mounted on the axle 16, and an inner spring 20 is engaged between the base 12 and an inner flange 18*b* (see FIG. 11) of the central tube 18 for biasing the central tube forwardly away from the base 12. An outer tube 22 is slidably mounted with respect to the central tube 18 and a central spring 24 is engaged between an outer flange 18*a* of the central tube 18 and an inner flange 22*b* (see FIG. 12) of the outer tube 22, for biasing the central tube forwardly away from the base 14. An outer spring 26 is engaged between on inner flange of the slide 12 and an outer flange 22*a* of the outer tube 22 for biasing the slide 12 forwardly of the base 14.

Figure 4:
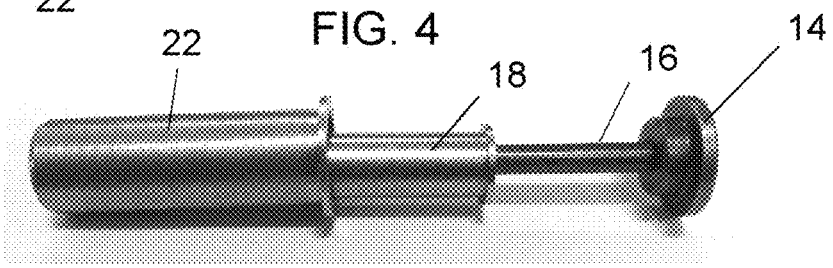
FIG. 4 is a side perspective view of the base, axle and tubes of the mechanism, without springs, for showing the rest position of the components.
Figure 5:
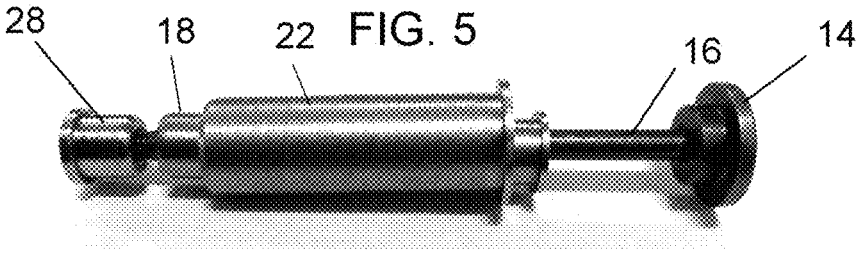
FIG. 5 is a side perspective view of the base, axle and tubes of the mechanism, without springs, for showing an intermediate position of the components, part way through a rearward part of the firing cycle, before the slide (not shown in FIG. 5) has moved to its rearward-most position.
Figure 6:
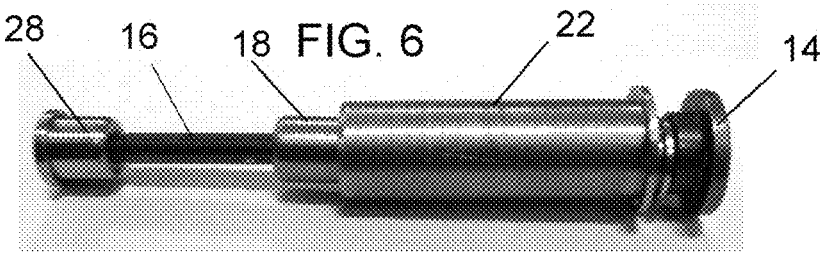
FIG. 6 is a side perspective view of the base, axle and tubes of the mechanism, without springs, for showing a rearward-most position of the components, at the end of the rearward part of the firing cycle, when the slide (not shown in FIG. 6) has reached its rearward-most position.

With reference to FIGS. 3 to 6, in operation, when a round is fired, the recoil mechanism of the invention moves from the rest position shown in FIGS. 3 and 4, to an intermediate rearward position shown in FIG. 5, where the outer spring 26 is substantially compressed while the central spring 24 is somewhat compressed and the inner spring 20 is slightly compressed. As the firing cycle continues, the slide 12 moves to its rearmost position and the recoil mechanism components are in the positions shown in FIG. 6. In this position of the components, the outer and central springs 26, 24, are compressed fully while the inner spring 20 is mostly compressed but not fully compressed so that some buffer is still provide to avoid the slide 12 mechanically engaging the rest of the firearm frame without some biasing cushion.

According to the invention, the springs and tubes are telescopically nested within each other so that they at least partly overlap. This shortens the overall length of the recoil mechanism while, at the same time, providing a full measure of recoil effect. Also, by dividing the usually single recoil spring into three nested parts, a new possibility of fine tuning the recoil characteristic become possible by selected different compression characteristics and lengths for the three springs.

In order to keep the components, including the tubes and springs, together, the mechanism of the invention includes a cap 28 connected, e.g. by mating threads, to the forward end of axle 16, at a location opposite from the base 12, for retaining the central and outer tubes 18 and 22, and the springs 20, 24 and 26, to the base and axle 14 and 16.

The central tube 18 is engaged over and is shorter than the axle 16 and the outer tube 22 is engaged over and is shorter than the central tube 18. The central spring 24 is engaged over and is shorter than the inner spring 20 and the outer spring 26 is engaged over and is shorter than the central spring 24.

Additional details concerning the dimensions and specifications of the components of the invention are illustrated in FIGS. 9 to 15.

By shortening the recoil mechanism of conventional design, which generally utilizes a single spring on a shaft, by dividing the spring into plural nested parts, and providing accommodating nested components, the inventor has found that similar or even better recall characteristic can be achieved in a much shorter space.

While a specific embodiment of the invention has been shown and described in detail to illustrate the application of the principles of the invention, it will be understood that the invention may be embodied otherwise without departing from such principles.

What is claimed is:

1. A reduced stroke length telescopic recoil mechanism for a firearm having a barrel (10) and a slide (12) movable rearwardly with respect to the barrel during an initial part of a firing cycle, and forwardly during an ending part of the firing cycle, the recoil mechanism comprising:

a base (14);

an axle (16) fixed to the base (14);

a central tube (18) slidably mounted on the axle (16);

an inner spring (20) engaged between the base (12) and the central tube (18) for biasing the central tube forwardly away from the base;

an outer tube (22) slidably mounted with respect to the central tube (18);

a central spring (24) engaged between the central tube (18) and the outer tube (22) for biasing the central tube forwardly away from the base (14); and an outer spring (26) engaged between the slide (12) and the outer tube (22) for biasing the slide (12) forwardly of the base (14).

2. The reduced stroke length telescopic recoil mechanism of claim 1, wherein the inner, central and outer springs and the central and outer tubes are telescopically nested with each other so that they at least partly overlap for shorting an overall length of the recoil mechanism.

3. The reduced stroke length telescopic recoil mechanism of claim 1, including a cap (28) connected to the axle (16) at a location opposite from the base (12), for retaining the central and outer tubes (18, 22) and the inner, central and outer springs (20, 24, 26) to the base (14).

4. The reduced stroke length telescopic recoil mechanism of claim 1, wherein each of the central and outer tubes (18, 22) have inner and outer flanges for engaging the inner, central and outer springs (20, 24, 26).

5. The reduced stroke length telescopic recoil mechanism of claim 1, wherein the central tube (18) is engaged over and is shorter than the axle (16), and the outer tube (22) is engaged over and is shorter than the central tube (18).

6. The reduced stroke length telescopic recoil mechanism of claim 1, wherein the central spring (24) is engaged over and is shorter than the inner spring (20), and the outer spring (26) is engaged over and is shorter than the central spring (24).

7. The reduced stroke length telescopic recoil mechanism of claim 1, including a cap (28) connected to the axle (16) at a location opposite from the base (12), for retaining the central and outer tubes (18, 22) and the inner, central and outer springs (20, 24, 26) to the base (12), the central and outer tubes (18, 22) having inner and outer flanges for engaging the inner, central and outer springs (20, 24, 26).

8. The reduced stroke length telescopic recoil mechanism of claim 1, wherein each of the central and outer tubes (18, 22) have inner and outer flanges for engaging the inner, central and outer springs (20, 24, 26), the central tube (18) being engaged over and being shorter than the axle (16), and the outer tube (22) being engaged over and being shorter than the central tube (18).

9. The reduced stroke length telescopic recoil mechanism of claim 1, wherein the central tube (18) is engaged over and is shorter than the axle (16), and the outer tube (22) is engaged over and is shorter than the central tube (18), the central spring (24) is engaged over and is shorter than the inner spring (20), and the outer spring (26) is engaged over and is shorter than the central spring (24).

10. The reduced stroke length telescopic recoil mechanism of claim 1, including a cap (28) connected to the axle (16) at a location opposite from the base (12), for retaining the central and outer tubes (18, 22) and the inner, central and outer springs (20, 24, 26) to the base (12), the central spring (24) being engaged over and being shorter than the inner spring (20), the outer spring (26) being engaged over and being shorter than the central spring (24), and the central and outer tubes (18, 22) having inner and outer flanges for engaging the inner, central and outer springs (20, 24, 26).

* * * * *